US006186417B1

(12) United States Patent
Ho et al.

(10) Patent No.: US 6,186,417 B1
(45) Date of Patent: Feb. 13, 2001

(54) FRONT PRESSURE-SWIRL ATOMIZER

(75) Inventors: Wu-Chi Ho, Hsinchu Hsien; Ling-Chia Weng, Chiayi Hsien; Tao-Pang Hsiung, Pingtung; Tzeng-Wuu Wey, Hsinchu Hsien, all of (TW)

(73) Assignee: Industrial Technology Research Institute, Hsinchu (TW)

( * ) Notice: Under 35 U.S.C. 154(b), the term of this patent shall be extended for 0 days.

(21) Appl. No.: 09/490,174

(22) Filed: Jan. 22, 2000

(51) Int. Cl.[7] ..... B05B 1/34

(52) U.S. Cl. ..... 239/491; 239/493; 239/496; 239/494

(58) Field of Search ..... 239/491, 493, 239/495, 496, 497, 494

(56) References Cited

U.S. PATENT DOCUMENTS 2,378,348 * 6/1945 Wilmes et al. ..... 239/491
2,508,788 * 5/1950 Hallinan ..... 239/496
2,904,263 * 9/1959 Tate et al. ..... 239/494
4,991,778 * 2/1991 Maas et al. ..... 239/496

* cited by examiner

*Primary Examiner*—Andres Kashinikow
*Assistant Examiner*—Dinh Q. Nguyen

(57) ABSTRACT

A front plunger pressure-swirl atomizer is disclosed, which is applied to a fuel atomizer of a micro gas turbine engine and includes a nozzle cap, a central plunger swirler, a central plunger fastening barrel. The front plunger pressure-swirl atomizer is installed at the seat of an engine. The present invention has the advantages of occupying a smaller space, only needing a small operating pressure, a simple flow channel structure, and fewer components, being easily assembled and a superior atomizing property. Therefore, the defects, such as complex finishing process of flow channel and difficult to be assembled, in the prior art are improved effectively.

1 Claim, 8 Drawing Sheets

FRONT PRESSURE-SWIRL ATOMIZER

FIELD OF THE INVENTION

The present invention relates to a front plunger simplex atomizer, wherein the simplex type atomizer can provide a superior atomization performance because of the appropriate design of liquid flow channel. A compact configuration arrangement is employed to meet the design requirements of small volume and high maintenance availability. As compared with the traditional design, not only present atomizer possesses a better energy conversion efficiency (from pressure to kinetic energy), but also it is easier to assemble.

BACKGROUND OF THE INVENTION

In general, the atomizer serves as an energy conversion mechanism to convert a volume of the liquid (such as the fuel) into a multiplicity of small droplets and then ejects these droplets so as to produce a high ratio of surface to mass in the liquid phase and thereby achieve high rates of mixing and evaporation. The atomizer may be used in applying agricultural chemicals to crops, paint spraying, spray drying of wet solid, food processing, cooling of nuclear cores, gas-liquid mass transfer applications, dispersing liquid fuels for combustion, and many other applications. As shown in FIGS. 1 and 2, the cross sectional view of a prior art atomizer and a nozzle which is installed with a nozzle cap are illustrated, respectively. The atomizer includes a seat 10, an oil supplying tube 12, a fuel supplying flow channel 12, an embedding rod 13 and a nozzle cap 14. As fuel flows to the fuel supplying chamber 15 from the fuel supplying tube 12, by the combination of the fuel supplying flow channel 11 and the seat 10, the fuel will pass through fuel supplying chamber 15, and then enters into the fuel supplying strip formed by the nozzle cap 14 and the embedding rod 13. The inner side of the nozzle cap is a hollow chamber. The vortex flow channels are constructed by the embedding rod 13 and the nozzle cap 14 from the vortex chamber 16. The fuel is accelerated through the vortex flow channel and then is ejected from a release orifice in order to attain the effect of atomization. The defect is that the seat 10 used in the pivotal axis atomizer is very complex (referring to FIG. 1), thus the finishing and assembling work are difficult. Moreover, the gaps after assembled is increased, thus the atomization effect is reduced.

Therefore, based on the principle of fluid dynamics, the object of the present invention is to design an atomizer which is suitable to be used in all kinds of industrial environments. Under different kinds of working fluid, there are some factors which will affect the performance of a pressure-swirl atomizer, which are:

1. Flow number (FN)
2. Differential pressure (ΔP)
3. Mass flow of the working fluid (dm/dt)
4. Pressure loss induced by the friction of flow channel.

Reducing Flow number, increasing differential pressure, reducing mass flow and pressure loss induced by the friction of flow channel are beneficial to the SMD (Sauter mean diameter). Since in various bad industrial working environment, such as small installation space (FN large), fewer number of nozzles (large mass flow ratio), lower differential pressure, etc. Thus, it is eagerly demanded to have a brand new design which can further reduce the SMD value and have the following specifications:

1. Low differential pressure, below 7 kg/cm$^2$(0.686 MPa).
2. High mass flow ratio.

3. High flow number FN=2.4×10-6.
4. Simple flow channel structure with fewer components, which may be easily finished and assembled
5. Reducing SMD value to less than 40 $\mu$m The fuel flow rate $\dot{m}_L$ and SMD can be expressed by $$\dot{m}_L = CdA_0(2\beta_L P)^{0.5} \tag{1}$$

$$SMD = 2.25\sigma^{0.25}\mu_L^{0.25}\dot{m}_L^{0.25}\Delta P_L^{-0.5}\rho_A^{-0.25} \tag{2}$$

According to the requirement of the fuel flow rate $\dot{m}_L$ and SMD value, we can decide the suitable operating pressure P, final orifice area $A_0$, and discharg coefficient $C_d$.

$$C_d = 0.45\left(\frac{d_0\rho_L U}{\mu_L}\right)^{-0.02}\left(\frac{l_0}{d_0}\right)^{-0.03}\left(\frac{L_S}{D_S}\right)^{0.05}\left(\frac{A_P}{D_S d_0}\right)^{0.52}\left(\frac{D_S}{d_0}\right)^{0.23} \tag{3}$$

Now, we decide the actual discharge velocity U, $d_0$, $l_0$, $D_s$, and $L_s$ by means of the mounting space to meet the required $C_d$ value.

The actual discharge velocity U can be obtained by velocity coefficient $K_V$, the ratio of the actual discharge velocity to the theorectical velocity corresponding to the total pressure differential across the nozzle, i.e., $$K_V = \frac{U}{(2\Delta P_L/\rho_L)^{0.5}} = 0.00376\,K^{0.29}\left(\frac{\Delta P_L\rho_L}{\mu_L}\right)^{0.2} \tag{4}$$

$$K = \frac{A_P}{D_S d_0} \text{ atomizer constant} \tag{5}$$

According to aforementioned requirement, a front plunger simplex atomizer is designed. The present invention has the following advantages: 1. Small installation space and low operation pressure. 2. Simple flow channel structure. 3. Fewer components. 4. Easily assembled without any error. 5. Easily controlling the gap by a central plunger fastening barrel is adapted.

SUMMARY OF THE INVENTION

Accordingly, the primary object of the present invention is to provide a front plunger simplex atomizer, which is applied to a fuel atomizer of a micro gas turbine engine and includes a nozzle cap, a central plunger swirler, and a central plunger fastening barrel. The front plunger simplex atomizer is installed at the seat which is the hub of an engine. The present invention has the advantages of occupying a smaller space, needing a small operating pressure, a simple flow channel structure, and fewer components, being easily assembled and a superior atomizing performance. Therefore, the defects, such as complex finishing process of flow channels and difficulties to be assembled, in the prior art is improved effectively.

The various objects and advantages of the present invention will be more readily understood from the following detailed description when read in conjunction with the appended drawing.

DETAILED DESCRIPTION OF THE PREFERRED EMBODIMENTS

Figure 1:
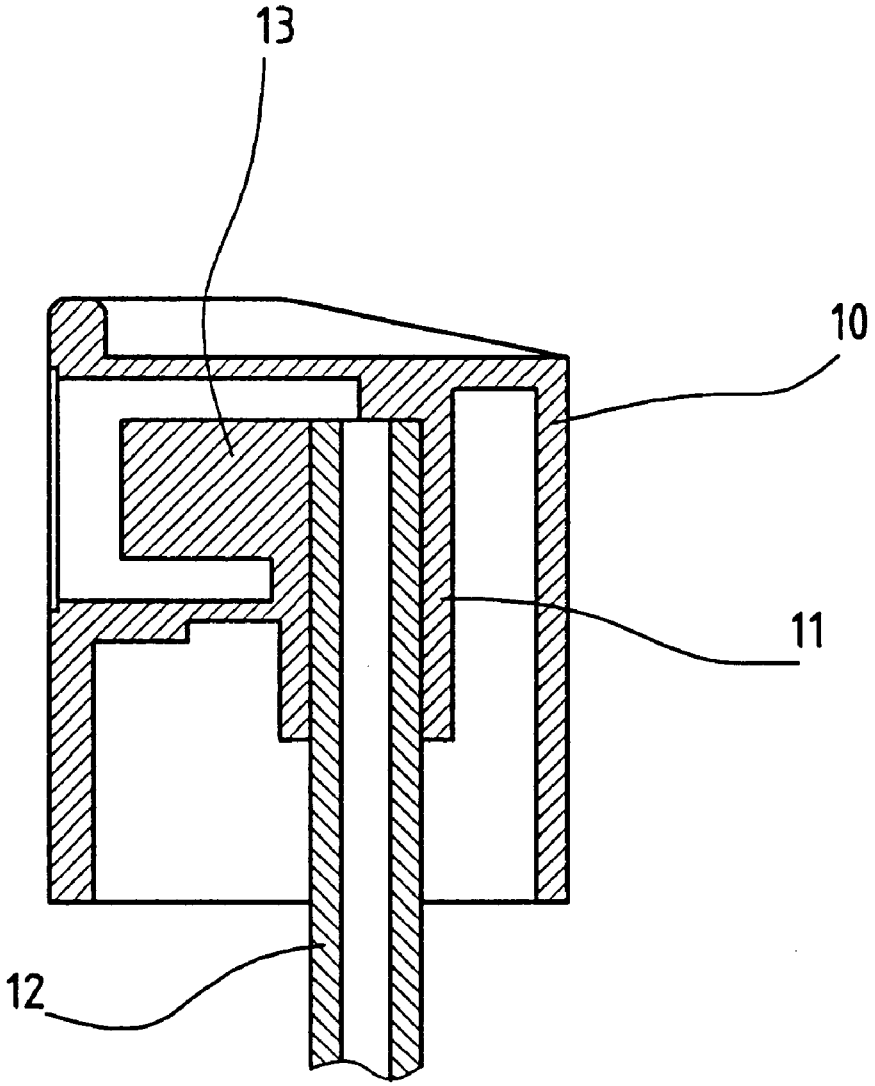
FIG. 1 is a cross sectional view showing the flow channel structure of a plurality of atomizer.
Figure 2:
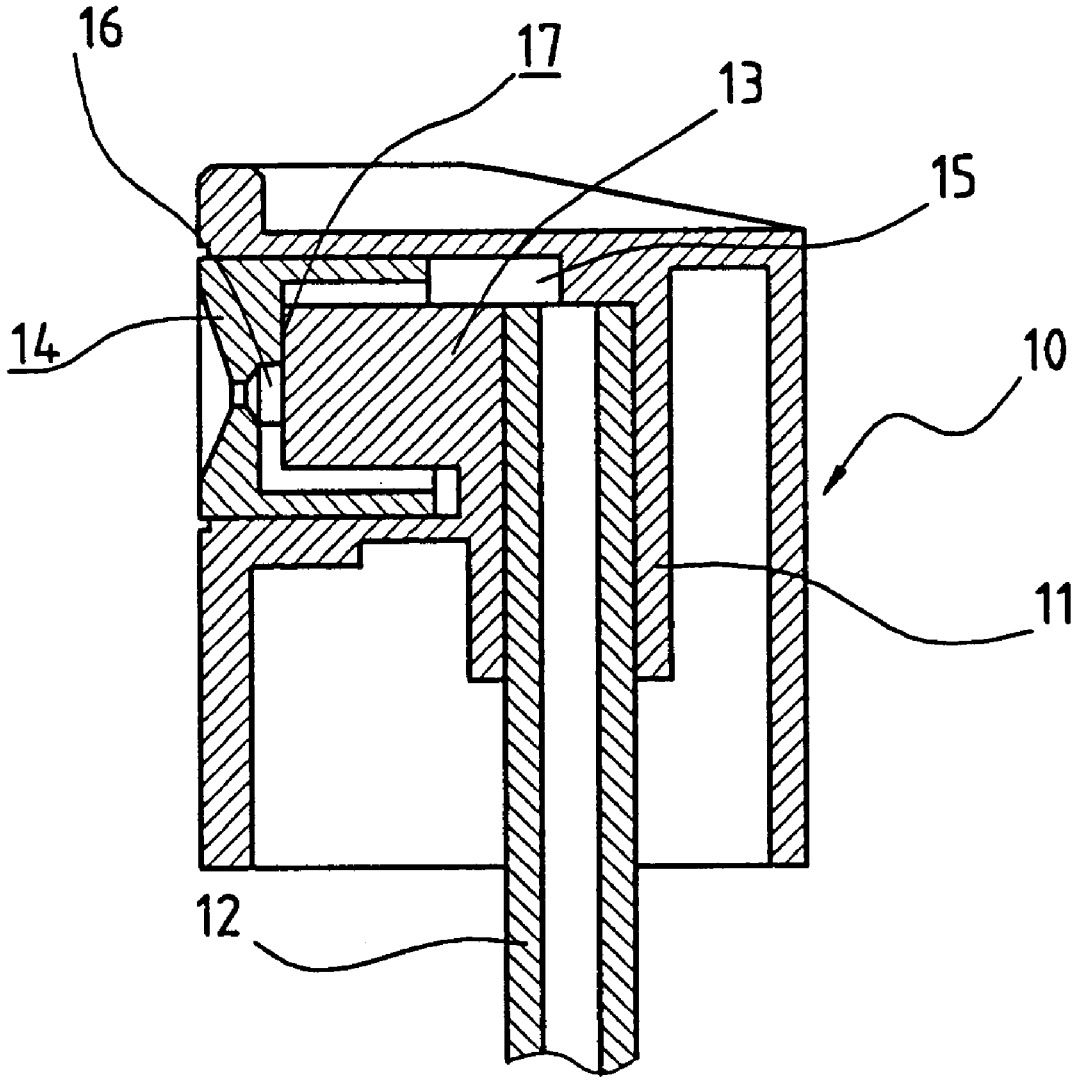
FIG. 2 is a schematic view of a prior art atomizer.
Figure 3:
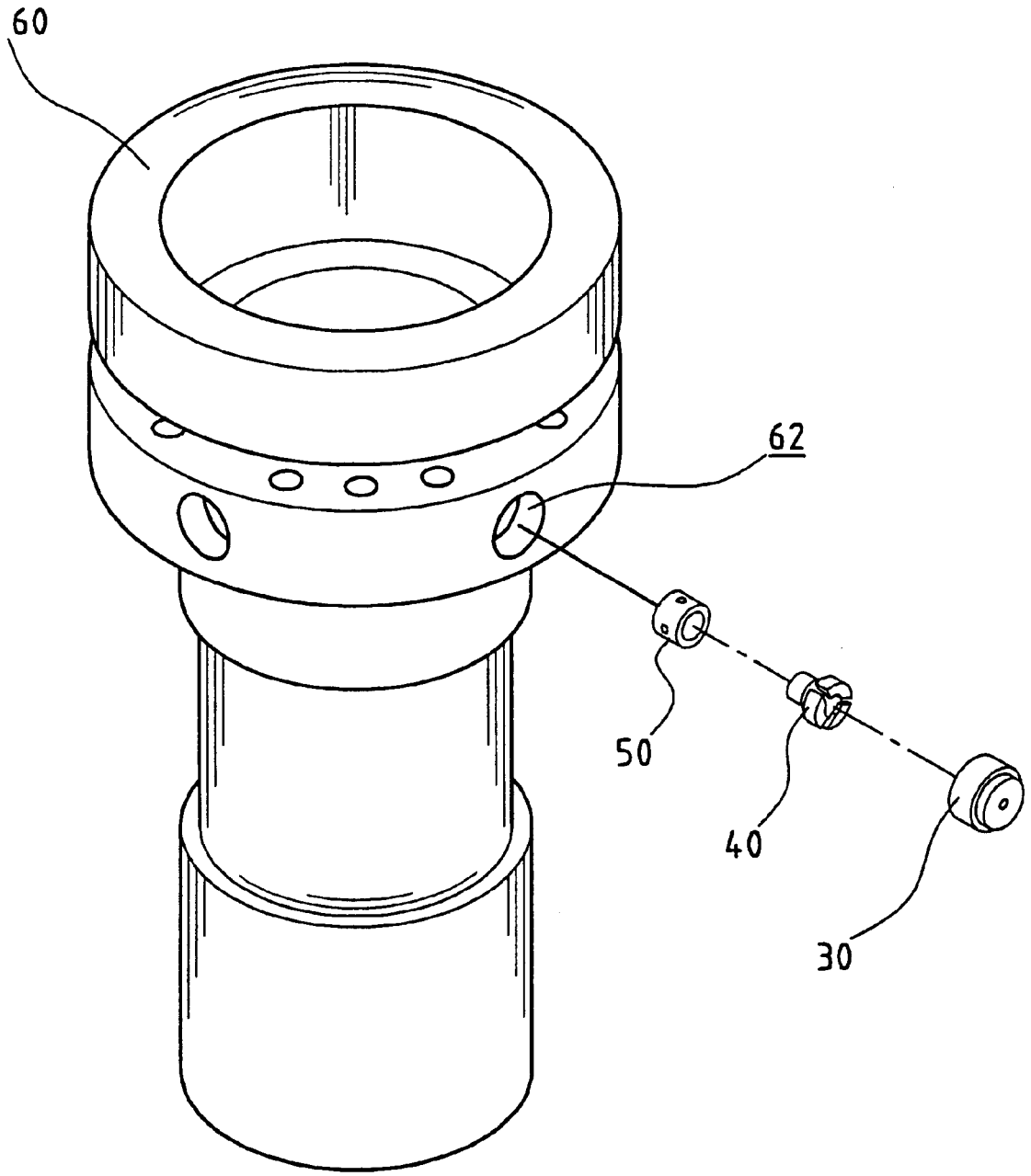
FIG. 3 is an explosion diagram of the present invention.

The explosion diagram of the present invention is illustrated in FIG. 3. The front plunger simplex atomizer of the present invention comprises the following components.

Figure 5:
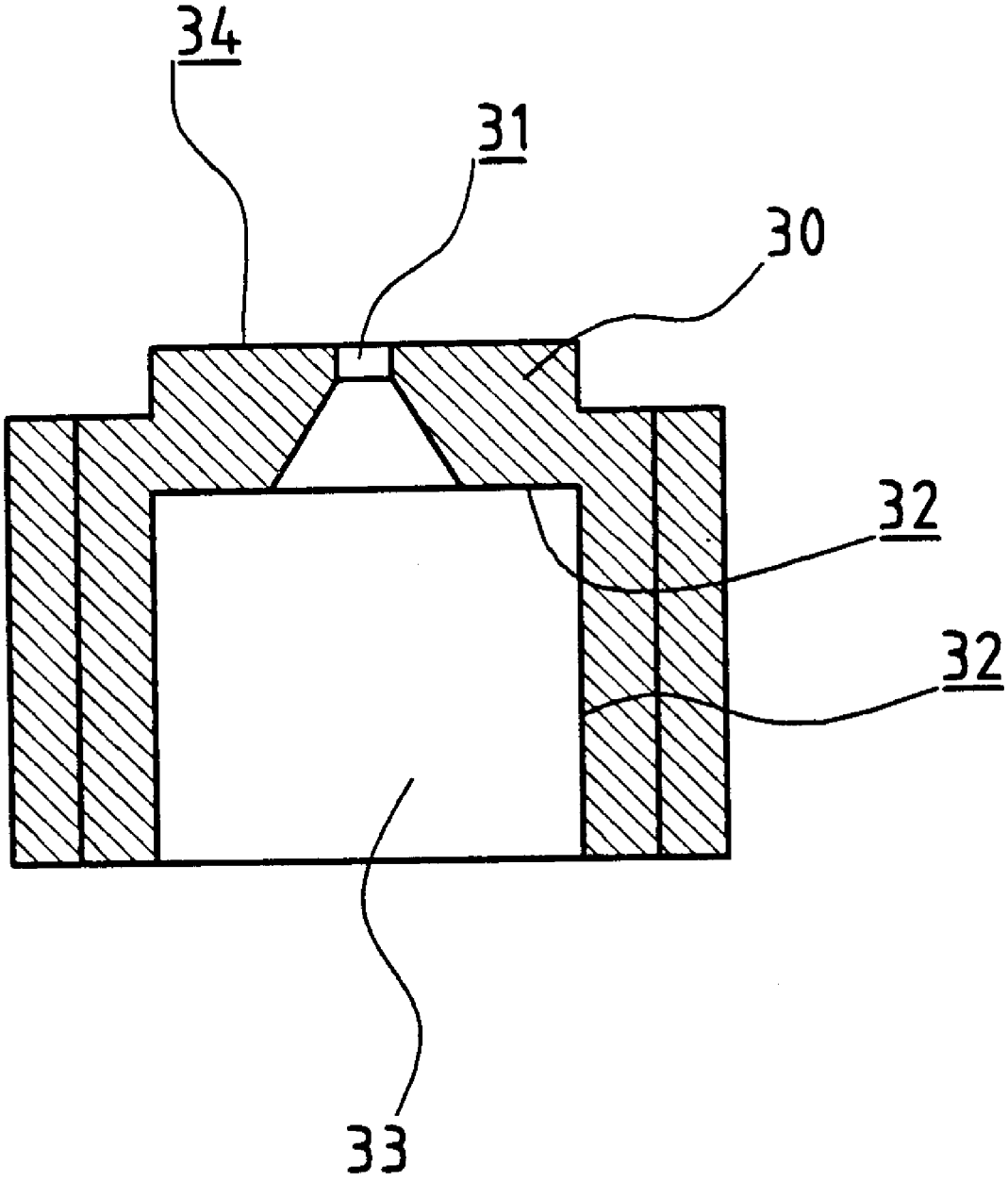
FIG. 5 is a cross sectional view showing the nozzle cap of the present invention.

A nozzle cap 30 (with reference to the cross sectional view shown in FIG. 5). A nozzle cap orifice 31 is formed on the upper end thereof. A fuel supplying chamber 33 is installed interior thereof.

Figure 6:
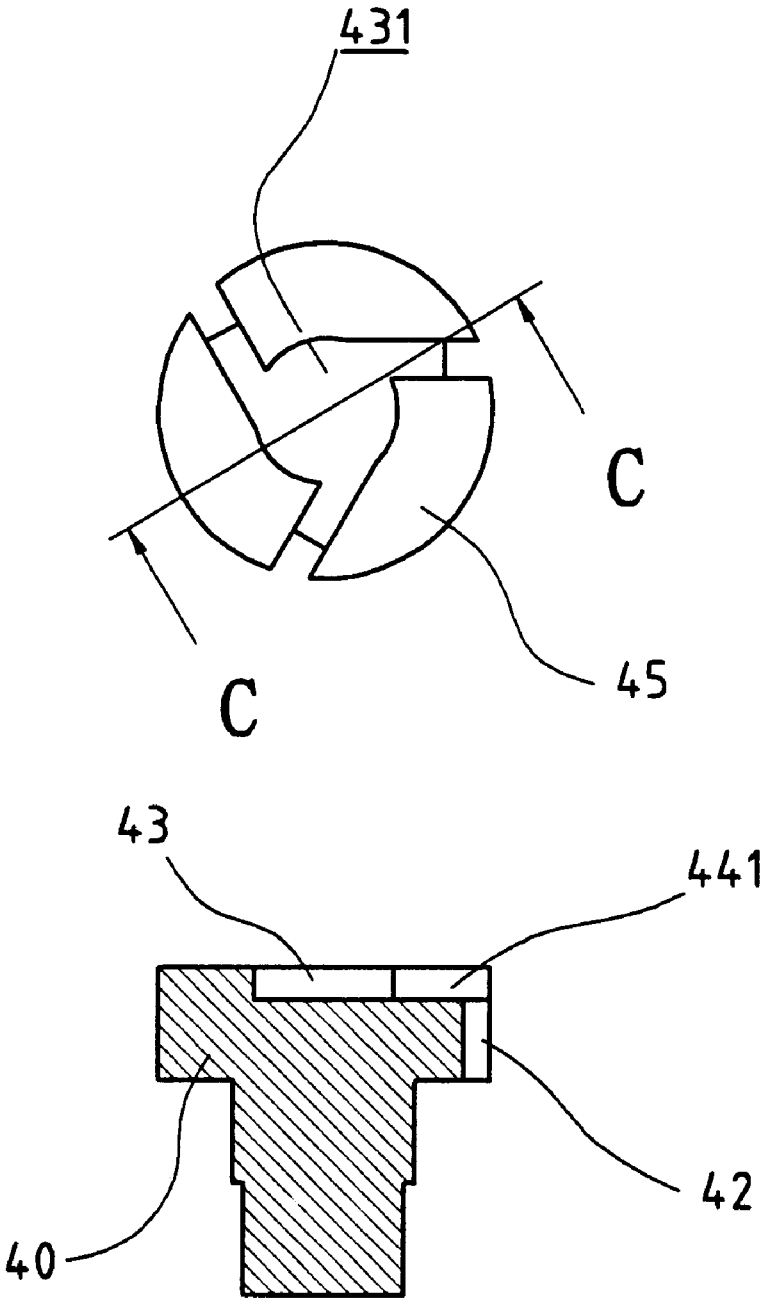
FIG. 6 is a cross sectional view showing the central plunger of the present invention.

A central plunger swirler 40 (referring to cross sectional view shown in FIG. 6). A plurality of fuel supplying ports 42 are installed on the proper positions in the lateral side thereof, and a vortex chamber 43 with tangential ports 44 is installed on the proper position at the upper ends thereof.

Figure 7:
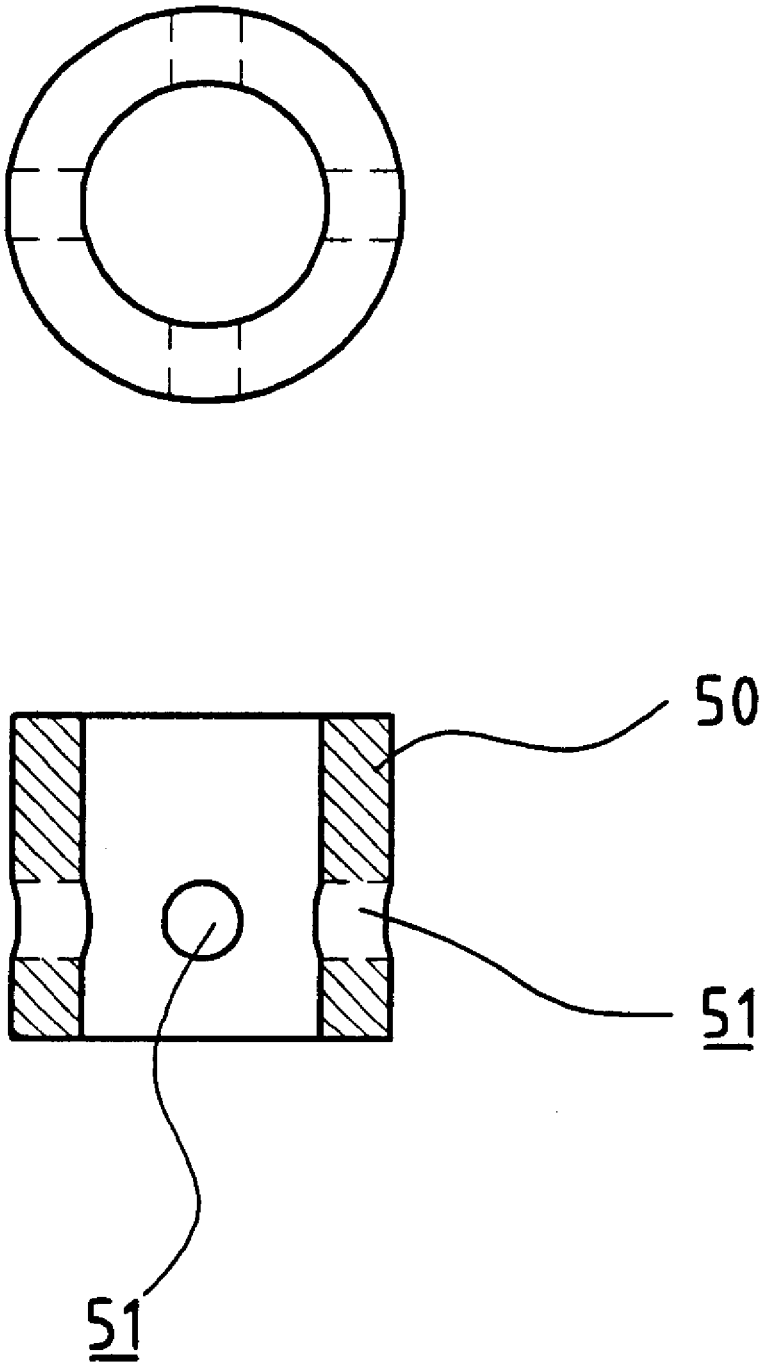
FIG. 7 shows the cross sectional view of a central plunger fastening barrel according to the present invention.

A central plunger fastening barrel 50 (referring to the cross sectional view shown in FIG. 7) is a hollow cylinder. A plurality of oil supplying holes 51 are installed at the lower end thereof. The central plunger fastening barrel is received within the cave 62 of the hub 60. Thus, oil flows into the present invention from the hub 60 is atomized.

Figure 4:
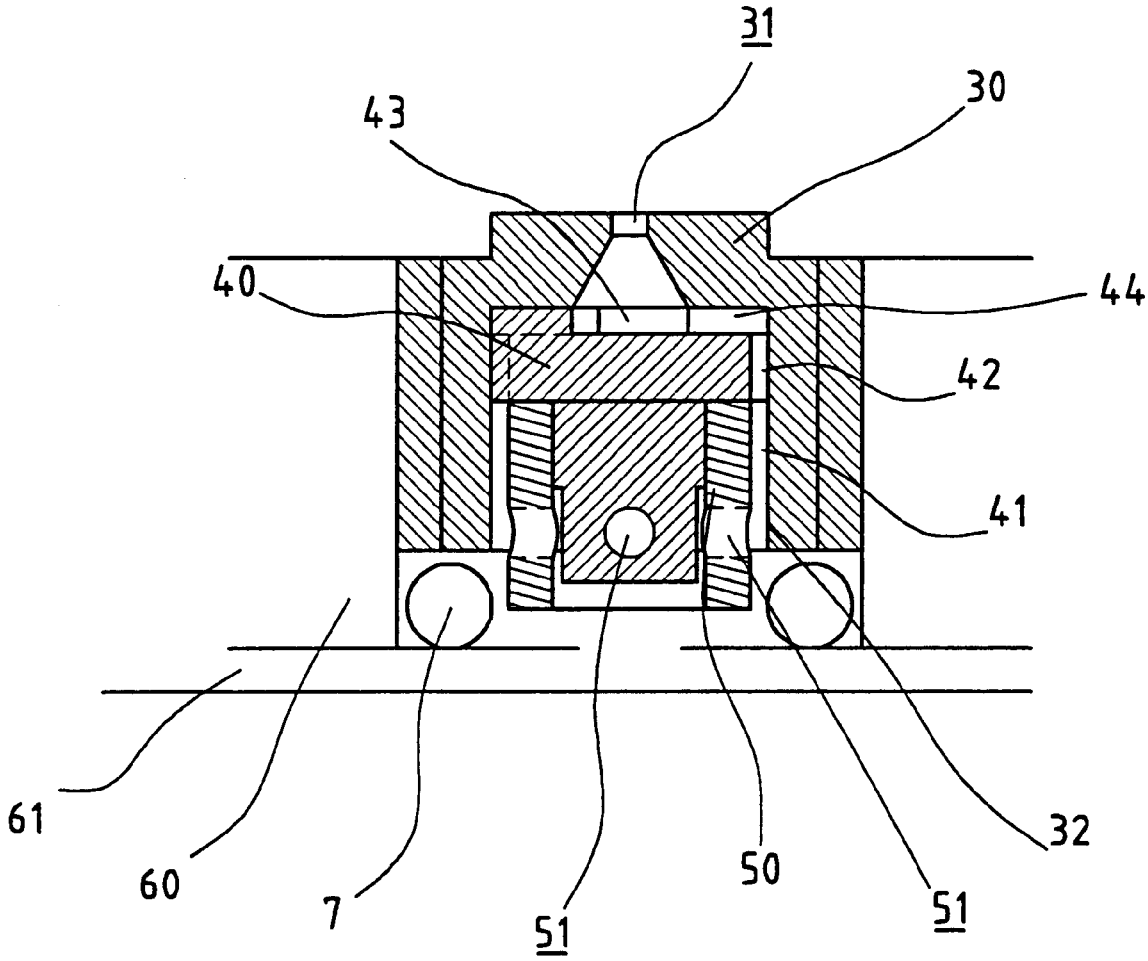
FIG. 4 is a cross sectional view of the present invention.

As shown in FIG. 4, the cross sectional view of the present invention is illustrated. An O ring 7, a central plunger fastening barrel 50, a central plunger swirler 40 are sequentially filled into the hub 60. Then nozzle cap 30 is locked into the hub 60 until the central plunger fastening barrel 50 is tightly adhered to the bottom of the cave 62 of the hub 60. Thus, the nozzle cap 30 is tightly sealed with the bottom of the cave 62 of the hub 60 through the O ring 7. Then the fuel flows to the central plunger fastening barrel 50 through the flow channel 61 of the hub 60, and then flows to the fuel supplying strip 41 from the fuel supplying holes 51. The fuel supplying strip 41 is formed by the space between the inner surface 32 of the nozzle cap and the outer surface 52 of the central plunger fastening barrel. The fuel enters into the fuel supplying ports 42 and then is fed into a vortex chamber 43 through tangential ports 44 that give it a high angular velocity, thereby creating an air-cored vortex. The outlet from the vortex chamber is the nozzle cap orifice 31, and the rotating fuel flows through this orifice under both axial and radial forces to emerge from the atomizer in the form of a hollow conical sheet. As the sheet expands its thickness diminishes, and it soon becomes unstable and disintegrated into ligaments and then drops in the form of a well-defined hollow-cone spray.

Figure 8:
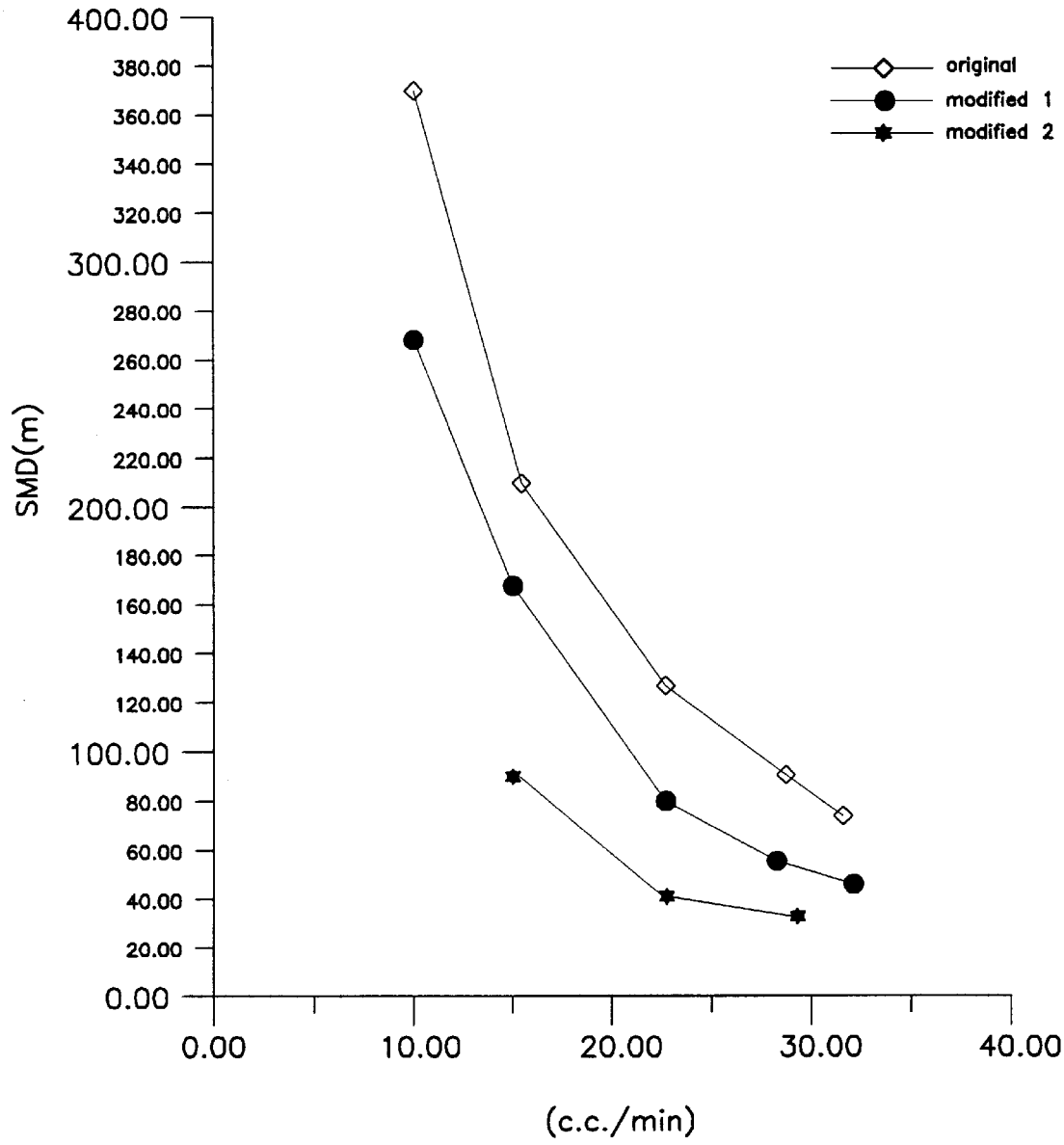
FIG. 8 shows a comparison of the performances between the present invention with the prior art.

The aforementioned finishing process of a nozzle needs to be polished and ultrasonic lapping. The finished surfaces include the outer surface 34 of the nozzle cap 30, the nozzle cap hole 31, the inner surface 32 of the nozzle cap, the surface 45 of the central plunger swirler, the surface 431 of the vortex chamber and the surface 441 of the fuel tangential ports of the central plunger swirler. From the aforementioned description, it is appreciated that the flow channel 60 the present invention can be embodied easily, thus it is suitable for the seat 61 of any type. Moreover, the finishing process is compact, therefore, in an operation condition of lower differential pressure, higher Flow number and higher mass flow rate, the SMD value can be reduced to below 40 $\mu$m (to a value of 32 $\mu$m). With reference to FIG. 8, after the present invention has been modified, the SMD value can be successfully reduce to below 40 $\mu$m. Thus the defect of an atomizer is improved effectively. Moreover, the present invention may be easily installed. Thus, it is time and cost saved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A front plunger pressure-swirl atomizer installed on a flow channel of a seat so that the flow channel have the function of atomizing liquid, comprising:

an Oring installed between the front plunger pressure-swirl atomizer and the flow channel of a seat;

a nozzle cap, the upper end thereof being installed with a nozzle cap hole, while the inner portion thereof being installed with a fuel supplying chamber;

a central plunger swirler, a plurality of fuel supplying ports being installed at the proper positions on the lateral side thereof and a vortex chamber being formed on the upper end thereof;

a central plunger fastening barrel being a hollow cylinder, a plurality of oil supplying holes being formed at the proper portions of the lower end thereof;

wherein during assembling, the O ring, central plunger fastening barrel, central plunger swirler are sequentially filled into the hub, then the nozzle cap is locked into the hub until the central plunger fastening barrel is tightly adhered to the bottom of the cave of the hub.

* * * * *